United States Patent [19]

Straubel et al.

[11] 4,279,385

[45] Jul. 21, 1981

[54] HIGH PRESSURE FUEL INJECTION APPARATUS FOR INTERNAL COMBUSTION ENGINES

[75] Inventors: Max Straubel; Willi Voit, both of Stuttgart, Fed. Rep. of Germany

[73] Assignee: Robert Bosch GmbH, Stuttgart, Fed. Rep. of Germany

[21] Appl. No.: 11,024

[22] Filed: Feb. 9, 1979

[30] Foreign Application Priority Data

Feb. 11, 1978 [DE] Fed. Rep. of Germany ..... 2805785

[51] Int. Cl.[3] ..... F02M 32/02; F02M 47/02

[52] U.S. Cl. ..... 239/90; 239/88

[58] Field of Search ..... 239/88–96; 123/139 AK, 139 AT, 139 E

[56] References Cited

U.S. PATENT DOCUMENTS

| | | | |
|---|---|---|---|
| 2,279,010 | 4/1942 | Nichols | 239/93 X |
| 3,831,846 | 8/1974 | Perr et al. | 239/95 X |
| 4,069,800 | 1/1978 | Kanda et al. | 123/139 E X |
| 4,170,974 | 10/1979 | Kopse et al. | 123/139 AK X |

*Primary Examiner*—Robert W. Saifer

*Attorney, Agent, or Firm*—Edwin E. Greigg

[57] ABSTRACT

A hydraulically driven piston pump and nozzle assembly for a high pressure fuel injection system is proposed, in particular one for Diesel engines, which has an assembly for raising the closing pressure for the purpose of accomplishing a rapid valve needle closing at the injection nozzle. The assembly substantially comprises a closing pressure chamber disposed in the region of the valve needle end remote from the valve seat, which chamber communicates via an overflow channel with an auxiliary pump chamber of an auxiliary pump piston which is driven together with the pump piston. At the termination of fuel delivery, fuel under increased pressure is conducted from the auxiliary pump chamber into the closing pressure chamber, from when this pressure is exerted, at least indirectly, upon the valve needle to cause an accelerated valve needle closing.

13 Claims, 5 Drawing Figures

HIGH PRESSURE FUEL INJECTION APPARATUS FOR INTERNAL COMBUSTION ENGINES

BACKGROUND OF THE INVENTION

This invention relates to a hydraulically driven piston pump and nozzle assembly for a high pressure fuel injection system of an internal combustion engine.

A fuel injection system with a pump/nozzle assembly is already known in which fuel which drives the hydraulic piston pump and is under servo pressure is conducted into the spring chamber and functions as a hydraulic spring. The effect of this aforementioned hydraulic spring can be varied by regulating the servo pressure. However, the opening as well as the closing pressure are both thereby varied in a disadvantageous manner and to the same extent.

In modern, high-powered Diesel engines, however, extremely short injection times are required for maximum performance. Furthermore, fuel injection operation must be terminated suddenly and very abruptly, if possible, within one degree of crankshaft rotation, because a delayed termination of the injection of fuel and the after-injections which frequently occur when special provisions are not available unfavorably and detrimentally influence combustion and lead to an elevated emission of hydrocarbons and carbon dioxide from the exhaust manifold. This requirement was partially satisfied in a different known fuel injection system of the basic design, where the pressure exerted on the valve needle is drawn from the controlled servo pressure chamber above the servo piston which drives the pump piston and is conducted into a pressure chamber which acts upon the valve needle. In this system, the elevation of the closing pressure is linked with the course taken by the servo pressure and is also limited by the maximum level for the servo pressure.

OBJECT AND SUMMARY OF THE INVENTION

It is the principle object of the invention to provide an improved hydraulically driven piston pump and nozzle assembly for the high pressure fuel injection system noted above.

The improved high pressure fuel injection system according to the invention has the advantage that the effective work surface and/or the effective pump stroke of the auxiliary pump piston, which is driven together with the pump piston, can be freely selected to be within relatively wide limits, without a significant influence on the mass and function of the piston pump and the injection nozzle. According to the invention, there is no interference with the induction stroke, and gas bubble formation is avoided, if the auxiliary pump chamber is attached to a pressure source via a refill valve. In a particular embodiment of the subject of the invention, the effective work surface area can be freely selected in the following manner. A piston which is larger in diameter than the pump piston and is disposed between the pump piston and the servo piston serves as the auxiliary pump piston. The effective work surface of this auxiliary pump piston is formed by the differential surface area between the cross-sectional surfaces of the pump piston and of the auxiliary pump piston. As a result of the effective work surface of the auxiliary pump piston, which moves into the auxiliary pump chamber during the pressure stroke of the pump piston, a pressure elevation in the closing pressure chamber can be attained which is proportional to the stroke of the pump piston. Thus the closing pressure elevation is adapted to the load, that is, to the quantity of fuel injected.

In order to avoid a premature elevation of pressure and a braking influence on the pump motion during the delivery stroke, in a fuel injection system, embodied in accordance with the invention and having disposed within the pump piston a relief channel which furnishes communication at the termination of injection between a pressure line leading to the injection nozzle and a chamber of lower pressure, the servo piston serves as the auxiliary pump piston, and the auxiliary pump chamber is formed by a portion of the intermediate chamber. After a return flow channel is closed off which serves to accomplish the pressure relief of the intermediate chamber and is controllable by the servo piston, this intermediate chamber is capable of being placed under elevated pressure and is in constant communication with the closing pressure chamber by means of the overflow channel. Thus, an elevation of the closing pressure can be controlled which is first undertaken after the termination of fuel delivery.

A particularly manageable constructive embodiment of an injection apparatus with a return flow channel which discharges in the wall of the intermediate chamber can be achieved by means of disposing the discharge point of the return flow channel, which is controllable by a control edge on the face of the servo piston oriented toward the intermediate chamber, at such a distance from the bottom surface from the intermediate chamber that the discharge point is closable at least approximately in the stroke position which the servo piston assumes at the beginning of the relief action of the pressure line, which is controlled by means of the relief channel in the pump piston. A particularly advantageous precise separation is obtainable between the closing pressure elevation, the relief, and the injection in an injection apparatus in accordance with the invention, provided with a control edge on the pump piston which blocks the communication between the pump work chamber and the pressure line for the purpose of controlling the end of fuel delivery. The means of obtaining this separation is that the closing off of the discharge point of the return flow channel is controllable at the same time as, or shortly after, the relief of the pressure line and that the connection between the pump work chamber and the pressure line can be closed by means of the control edge at the same time as, or shortly before, the relief of the pressure line.

A simple structure is obtained when the pressure chamber is embodied in a manner which is per se known by the spring chamber which includes the closing spring.

In order to reduce the large clearance volumes which negatively influence the function of the mechanism for raising the closing pressure, it is of particular advantage to provide for separation of the pressure chamber from the spring chamber in a manner which is per se known by means of an intermediate piston which is fitted tightly within the valve housing and to provide that the intermediate piston, which projects into the opposite end of the spring chamber from the valve needle, is displaceable toward the valve needle by means of the elevated fuel pressure, which is made effective within the closing pressure chamber. A control assembly for raising the pressure at the injection nozzle, which substantially comprises the auxiliary pump chamber, overflow valve, and closing pressure chamber, has a safety valve for the purpose of limiting the pressure therein, in order to reduce impermissible peak pressure levels.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
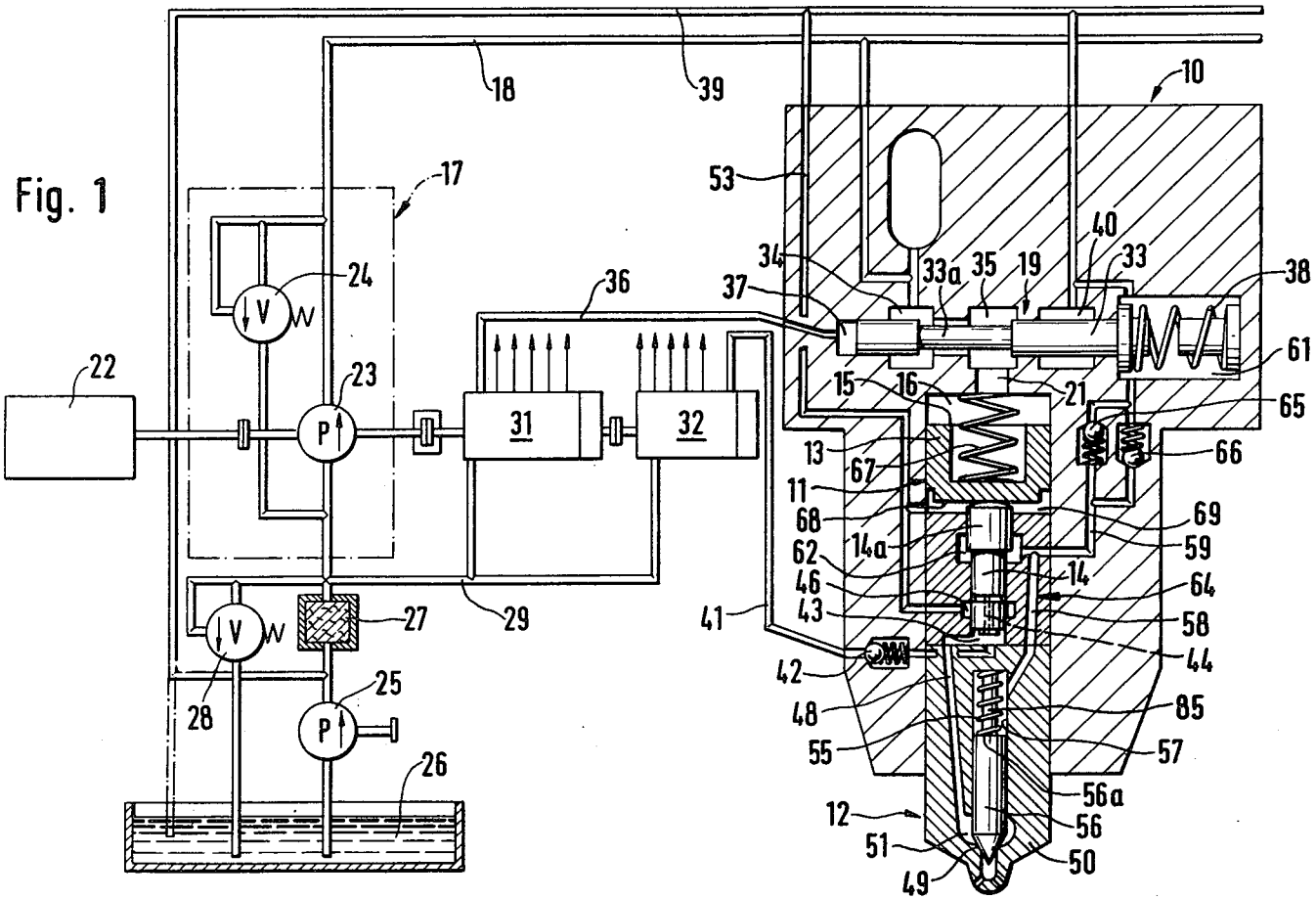
FIG. 1 is a schematic and partially sectional illustration of a fuel injection system according to the invention including a detail of the pump/nozzle assembly of the invention.

Turning now to FIG. 1, there will be seen the first embodiment of a high pressure fuel injection system including a pump/nozzle assembly 10 which consists substantially of a hydraulically driven piston pump 11 and an injection nozzle 12 embodied as a pressure-controlled injection valve. In a known manner, the piston pump 11 is embodied as a servo piston pump, i.e., it includes a servo piston 13 and a pump piston 14, together constituting a differential piston. The face 15 of the servo piston 13 movably defines one wall of a servo pressure chamber 16 to which is admitted fuel under servo pressure $P_S$ coming from a pressure source 17 via a supply line 18, a switching valve 19 and a control line 21.

The pressure source 17 generating the servo pressure consists substantially of an adjustable servo pressure pump 23 driven by a motor 22 and including a pressure-limiting or control valve 24. The servo pressure pump 23 is fed by a low pressure pump 25 serving as the first supply pump, which aspirates fuel from a tank 26 through a filter 27 and delivers it to the servo pressure pump 23. The supply pressure of the low pressure pump is limited by a further pressure-limiting valve 28. A branch line 29 supplies fuel from the supply pump 25 to pressure distributors 31 and 32.

The switching valve 19 is embodied as a sliding spool valve and the control slide 33 moves in the top of the pump/nozzle assembly 10 where it is illustrated in its normal position, i.e., when the nozzle is closed. In that position, the slide 33 connects the servo pressure chamber 16 with the servo pressure supply line 18 by permitting communication between a first annular chamber 34 and a second annular chamber 35 via a region of reduced diameter 33*a*. The control slide 33 may be axially moved, in particular into its second position, not shown, by a pressure control pulse produced by the pressure unit 31 in synchronism with the speed of the motor 22. This control pressure is fed via a line 36 to a control pressure chamber 37. In the second position of the control plunger 33, communication is established between the servo pressure chamber 16 through the control line 21, the annular chamber 35, the reduced region 33*a* and the third annular chamber 40 of the valve 19. The annular chamber 40 is connected to a return line 39 which terminates in the junction between the supply pumps 25 and 23 and thus experiences the pressure of the low pressure pump 25. It will be understood that the return line 39 could also be terminated in the tank 26 where only atmospheric pressure prevails, or a remnant pressure determined by the output resistance.

The pressure unit 31 may be a known rotary distributor or a piston pump or a solenoid controlled mechanism which permits movement of the control plunger 33 into its illustrated position by relieving the pressure in the chamber 37, thereby initiating the injection process as servo fuel is fed into the servo pressure chamber 16. The second pressure unit 32 is a fuel metering system connected through a filling line 41 and the filling valve 42 with a pump work chamber 43 defined by the pump piston 14. The fuel metering system could also be any suitable injection pump driven as illustrated by the motor 22. Both pressure units 31 and 32 will not be further described because they are not directly involved in the subject of the present invention.

Figure 2:
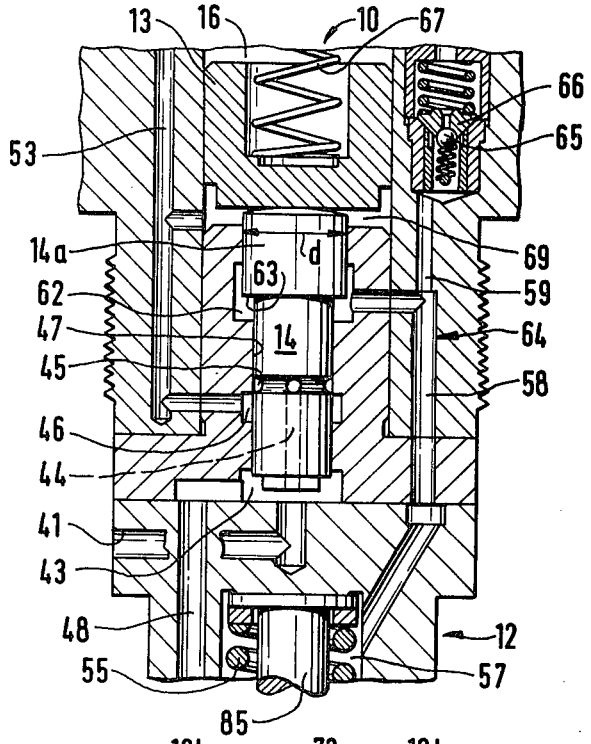
FIG. 2 is an illustration of a second embodiment of the pump/nozzle of the invention.

The pump piston 14 is shown, both in FIG. 1 and in the enlarged illustration of a practical embodiment thereof in FIG. 2, in the position of rest which it assumes after the end of the supply stroke and after relief is begun for the pump work chamber 43. As may be best seen in FIG. 2, the pump piston 14 has a relief channel 44 embodied as an axial bore, which discharges into an annular groove 45 machined into the jacket surface of the pump piston 14 and which is connected, when the pump piston 14 is in the illustrated position and during the further downward stroke of this pump piston 14, with an annular chamber 46 provided in the wall of a pump cylinder 47 which receives the pump piston 14. By this means, via a pressure line 48, a pressure chamber 51 of the injection nozzle 12 which is adjacent to the valve seat 49 (FIG. 1) and machined into a valve housing 50 is relieved toward a return flow channel 53 attached to the annular chamber 46. The return flow channel 53 communicates with the return line 39 which is under presupply pump pressure, so that in the present case relief to supply pump pressure takes place. If a higher standing pressure is desired, then the return channel 53 may also be attached to the servo pressure source 17, as is described below in connection with FIGS. 3–5, so that the relief takes place to the servo pressure. A relief to atmospheric pressure is possible if, as is indicated in broken lines, the return line 39 is extended directly into the tank 26.

In a known manner, the valve seat 49 of the injection nozzle 12 is obturated between injection events, that is, in the pauses between injections, by a valve needle 56 which is urged to move toward the valve seat by a closing spring 55.

A spring chamber 57, which houses the closing spring 55 and is adjacent to the end 56*a* of the valve needle 56 remote from the valve seat 49, is connected via an overflow channel 58 and a channel 59 with a chamber 61 encompassing the spring 38 of the switching valve 19. The chamber 61 is relieved to the return line 39. The channels 58 and 59 are additionally attached to an annular auxiliary pump chamber 62 and into which a section 14*a* of the pump piston 14 plunges. The section 14*a* has a larger diameter than that of the pump piston 14 and serves as an auxiliary pump piston.

The stepped area formed by the transition from pump piston 14 to its auxiliary pump 14*a* is indicated by reference numeral 63 (see FIG. 2) and serves as the effective working surface of the auxiliary pump piston 14*a*. By means of this effective working surface 63 which moves into the auxiliary pump chamber 62 during the pressure stroke of the pump piston 14, a pressure increase in, the spring chamber 57, which serves as the closing pressure chamber for a control assembly 64 which raises the closing pressure, can be attained which is proportional to the stroke of the pump piston 14. The assembly 64 for raising the closing pressure, which substantially comprises the auxiliary pump chamber 62, the auxiliary pump piston 14*a*, the overflow channel 58, and the closing pressure chamber 57, is attached via a refill valve 65 inserted into the channel 59 to the return line 39, which is under supply pump pressure and serves as the pressure source for this assembly 64. The purpose for the connection of the assembly 64 to the return line 39 is to be able to compensate for loss due to leakage and to avoid the formation of gas bubbles during the induction stroke.

As FIG. 1 shows, there is a further safety valve 66 inserted into the channel 59 parallel to the refill valve 65, in order, if desired, to limit the pressure increase in the assembly 64, which is generated by the auxiliary pump piston 14*a*, to some highest permissible pressure. In order to save space, both valves can also be united in a single valve in the form of an equal-pressure relief valve, as is shown in FIG. 2.

The previously described auxiliary pump piston 14*a*, formed by a section of the pump piston 14 having an enlarged diameter, can also be embodied separately from the pump piston 14 as a piston 14*a* of larger diameter than the pump piston 14 disposed between the pump piston 14 and the servo piston 13. The effective working surface of this auxiliary pump piston 14*a* is formed by the differential surface 63 of the cross-sectional surfaces of the pump piston and the auxiliary pump piston, in the same manner as in the previously described piston embodied as a stepped piston. The servo piston 13, with its face 68 oriented toward the pump piston 14, defines an intermediate chamber 69 which is pressure-relieved to the return flow channel 53 and thus to the return line 39.

The following will describe the mode of operation of the assembly 64 for raising the closing pressure, which forms the heart of the invention. The basic function of the fuel injection apparatus as a whole is known, for example from German Offenlegungsschrift (laid open application) No. 2,558,789.

In order to maintain the frictional connection between the pistons 13, 14*a* and 14 even during the relief of the servo pressure chamber 16 controlled by the switching valve 19, the servo piston 13 operates during the filling stroke against the force of a return spring 67. During the filling stroke, fuel metered by the fuel metering system 32 is first introduced into the pump work chamber 43 via the filling line 41 and the filling valve 42. The pump piston 14, the auxiliary pump piston 14*a* and the servo piston 13 perform a filling stroke corresponding to this supplied quantity of fuel, during which stroke the auxiliary pump chamber 62 as well is enlarged in volume. By this means, the previously increased pressure in the assembly 64 which serves to raise the closing pressure is lowered, and the chamber is filled if necessary through the refill valve 65. If, when the control line 36 is relieved by the pressure unit 31 and the control pressure chamber 37 is correspondingly relieved, the control plunger 33 of the switching valve 19 is pushed by the spring 38 into the position shown in FIG. 1, then at this time the servo pressure chamber 16 is placed under pressure via the supply line 18, the annular chambers 34 and 35 and the control line 21, and the pump piston 14 is pushed by the servo piston 13 toward the injection nozzle 12. Thus in this way, in accordance with the displacement of both pistons 13, 14, a correspondingly higher injection pressure is built up in the pump work chamber 43. This increased injection pressure contacts the pressure step of the valve needle 56 in the pressure chamber 51 of the injection nozzle 12 and lifts the valve needle 56 from its valve seat 49 against the force of the closing spring 55, as a result of which injection then begins. The termination of injection is triggered in the embodiment described in accordance with FIGS. 1 and 2 by means of opening the relief channel 44, which also determines the termination of fuel supply. During the supply stroke described, the fuel which is contained in the assembly 64 and prevented from flowing back by the refill valve 65 undergoes a pressure increase which is proportional to the cross-section of the effective work surface 63 on the auxiliary pump piston 14*a*. This pressure increase leads to an increase of the closing pressure in the spring chamber 57 which serves as the closing pressure chamber and reinforces the spring force of the closing spring 55, by which means the valve needle 56 is accelerated onto its valve seat 49. The elevation of closing pressure which is attainable by means of this assembly 64, as has already been noted above, is dependent upon the selection of the cross-section of the auxiliary pump piston 14*a* and upon the stroke of the pump piston 14; thus it is also load-dependent. That is, the pressure elevation takes place in proportion to the quantity of fuel stored up in the pump work chamber 43 and injected via the injection nozzle 12.

An elevation of the closing pressure which is controlled in this manner enables a very low opening pressure at the injection nozzle 12; it is capable of being separately controlled and limited; and it has no disadvantageous influence on either the pump delivery or the relief of the pressure line 48.

Figure 3:
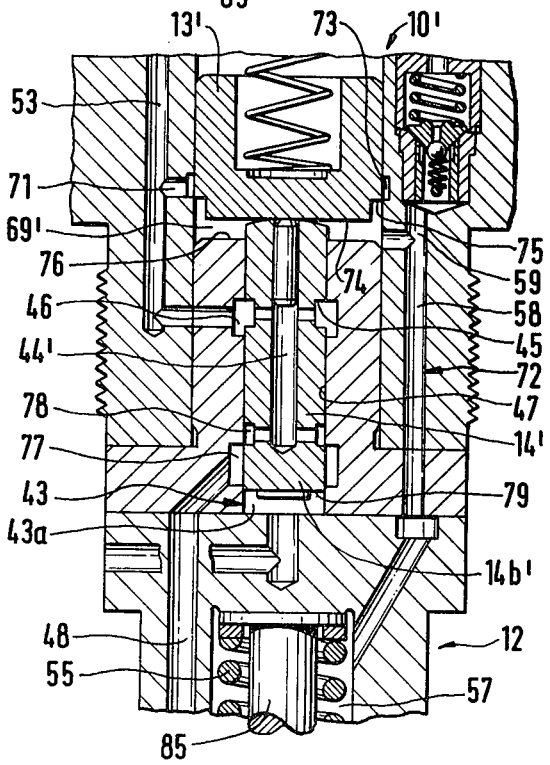
FIG. 3 is an illustration of a further embodiment of the invention.

The embodiment of FIG. 3, which generally corresponds to FIG. 2 in a larger scale and is shown only partially but with the essential features of the invention, differs from the first embodiment of FIGS. 1 and 2 substantially in that in place of the auxiliary pump piston 14*a*, the servo piston 13' serves as the auxiliary pump piston. The associated auxiliary pump chamber is embodied here by a portion of the intermediate chamber 69', which is placed under increased pressure during the remaining further stroke of the servo piston 13' after the closing off of a return flow channel 71, which channel serves to pressure-relieve the intermediate chamber 69' and is controllable by the servo piston 13'. The portion of the intermediate chamber 69' which serves as the auxiliary pump chamber, like the auxiliary pump chamber 62 of FIGS. 1 and 2, is in continuous communication via the overflow channel 58 with the spring chamber 57 of the injection nozzle 12, which serves as the closing pressure chamber. Thus, the auxiliary pump chamber 69', the overflow channel 58, and the spring chamber 57 together comprise an assembly 72 for raising the closing pressure. In FIG. 3, the servo piston 13' is shown in exactly that position in which a discharge point 73 of the return flow channel 71, which point is embodied as an annular groove, is closed off by a control edge 75 on the face 74 of the servo piston 13 oriented toward the intermediate chamber 69'. After this closing has taken place, the previously described elevation of pressure in the spring chamber 57 is generated. The annular groove 73 is located at a distance from the bottom surface 76 of the intermediate chamber 69' such that the discharge point 73 is closable at least approximately in the stroke position assumed by the servo piston 13' at the beginning of the relief of the pressure line 48, which is controlled by means of the relief channel 44' in the pump piston 14'. In order to prevent any influencing of the end of delivery, the control edges and channels are so designed that the closing of the discharge point 73 of the return flow channel 71 is controlled at the same time as, or shortly after, the relief of the pressure line 48. In the illustrated position of the pistons 13' and 14', the discharge point 73 has just been closed by the control edge 75, while the pressure line 48 in the injection nozzle 12 is already connected with the return flow channel 53, the connection being effected via a second annular chamber 77 machined in the wall of the pump cylinder 47, a corresponding second annular groove 78 in the pump piston 14, the relief channel 44', the annular groove 45, and the annular chamber 46.

In order that the relief takes place separately from the pump delivery and that the injection pressure does not prematurely drop before the end of delivery, a control edge 79 is disposed on the end 14*b*' of the pump piston 14' oriented toward the pump work chamber in such a way that the connection between the pump work chamber 43 and the pressure line 48 is closed at the same time as or shortly before the relief of the pressure line 48. In the illustrated position (see FIG. 3) of the pump piston 14', the control edge 79 of the pump piston 14' is already below the lower limit of the second annular chamber 77.

The return flow channel 53 and the channel 59 are connected with the return flow line 39, as is illustrated in connection with the first embodiment in FIG. 1, so that both relief of the pressure line 48 and the refilling of the intermediate chamber 69' to pre-supply pump pressure or tank pressure take place during the intake stroke.

Figure 4:
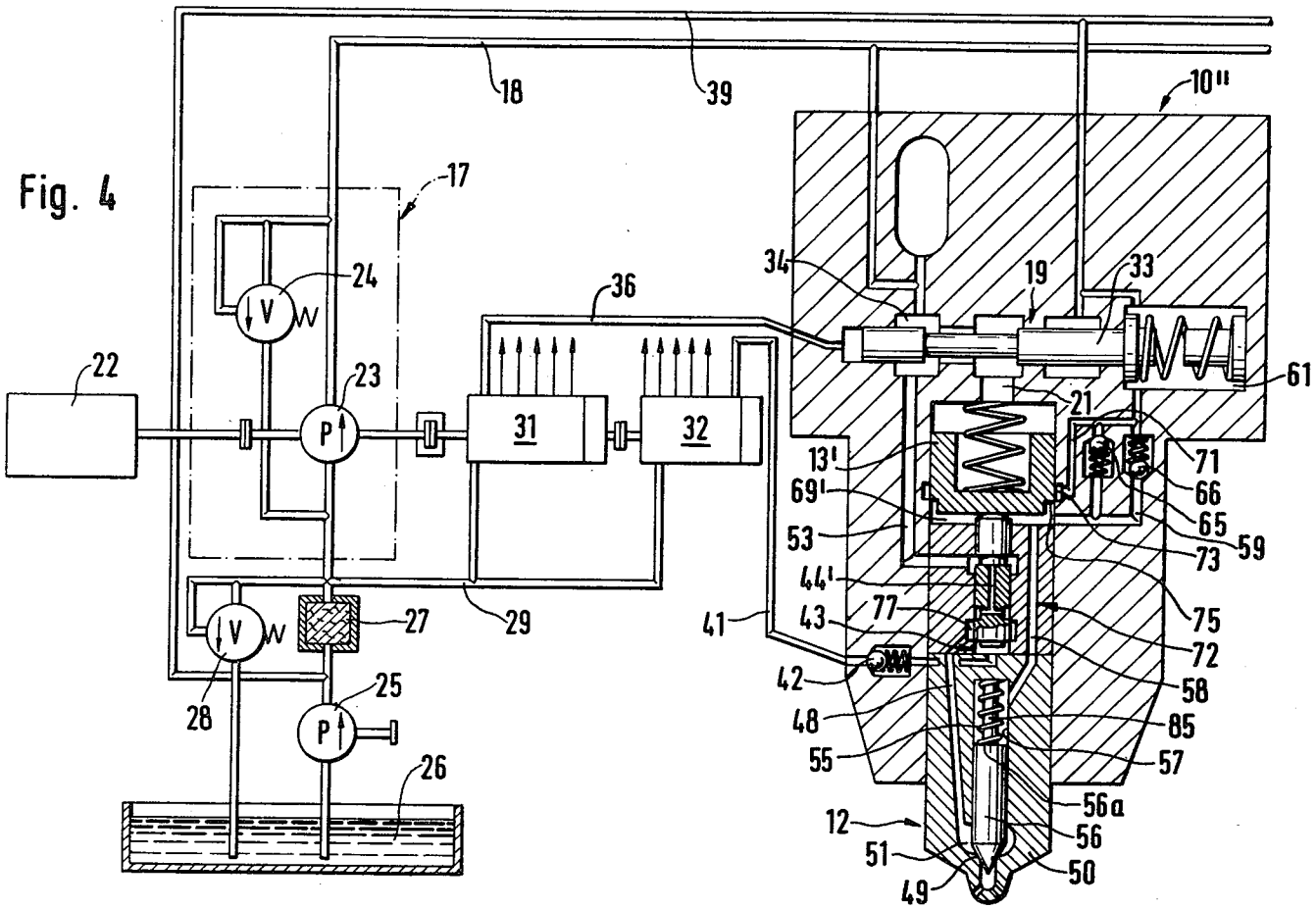
FIG. 4 is a schematic and partially sectional illustration of the third embodiment of the invention with the pump/nozzle containing the piston of FIG. 3.

The embodiment of the invention shown in simplified form in FIG. 4 corresponds functionally to the embodiment of FIG. 3, but here the pressure line 48 is relieved to servo pressure, by which means an accordingly higher standing pressure is controllable in the pressure line 48. Thus, in contrast to the first and second embodiments of the invention, the return flow channel 53 communicates with the annular chamber 34 of the switching valve 19, which chamber is connected to the supply line 18 and is under servo pressure $P_S$. The assembly 72 for raising the closing pressure is the same as in FIG. 3, except that here the discharge point 73 embodied as an annular groove is connected above the valves 65 and 66 via the return flow channel 71 to the channel 59, which in turn communicates with the return flow line 39 via the chamber 61. In this way, a pressure relief of the intermediate chamber 69', in the pump/nozzle 10'' of this embodiment, is effected to the pre-supply pump pressure or the tank pressure.

Figure 5:
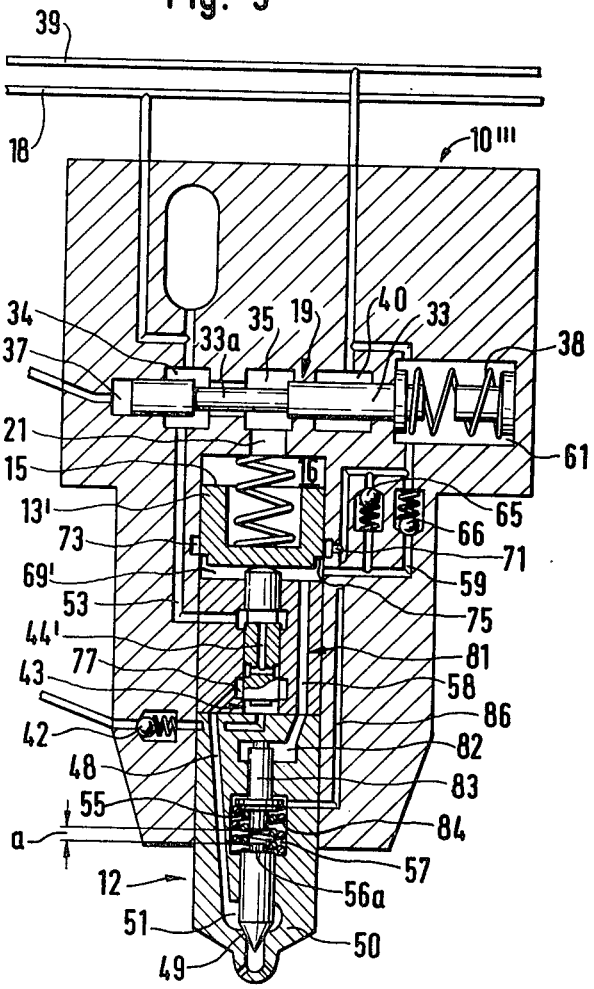
FIG. 5 is a schematic illustration of the pump/nozzle of the fourth embodiment of the invention and further including a modified mechanism for raising the closing pressure.

The fourth embodiment of the invention illustrated in FIG. 5 of a pump/nozzle 10''' has an assembly 81 for raising the closing pressure, in which the auxiliary pump chamber 69' communicates via the overflow channel 58 with a closing pressure chamber 82. This chamber 82 is separated from the spring chamber 57, which includes the closing spring 55, by means of an intermediate piston 83 sealingly guided within the valve housing 50. The intermediate piston 83 projects into the end of the spring chamber 57 opposite the valve needle 56 and serves as a support for both the closing spring 56 and a further return spring 84, which support is displaceable toward the valve needle 56 by means of the fuel pressure generated in the pressure chamber 82 of the assembly 81 for raising the closing pressure. In this way, either the initial stressing of the closing spring 55 is increased at a corresponding distance of the valve needle 56 from the intermediate piston 83, thus accelerating the closing speed, or else the valve needle 56 is mechanically moved onto the valve seat 49 at a distance a between both parts which corresponds to the valve needle stroke. By means of the employment of the intermediate piston 83, the closing pressure chamber 82 can be kept very small in volume, so that an exact control of the closing pressure elevation can be accomplished. In the previously described embodiments of FIGS. 1–4, the volume of the spring chamber 57 is substantially reduced in a known manner by means of a filler 85, but the clearance volume remains greater than in the example shown in FIG. 5.

The annular groove 73, as in the embodiment of the invention of FIG. 4, is disposed above the valves 65 and 66 via the return flow channel 71 to the channel 59 which leads to the chamber 61, and, as FIG. 5 shows, this channel 59 extends lengthwise, by means of a connecting channel 86, to the spring chamber 57, so that the latter chamber as well is relieved to pre-supply pump pressure or tank pressure via the return flow line 39.

The functioning of the embodiments of the invention shown in FIGS. 3, 4, and 5 differs from that of the function of the example shown in FIGS. 1 and 2 principally in their provision for control of the instant when the elevation of the closing pressure takes place in the closing pressure chamber 57 or 82, which is precisely accomplished with respect to timing by means of the association of the discharge point 73 with the control edge 75. Furthermore, no auxiliary pump piston is required, since its function is taken over in this embodiment by the servo piston 13'. As was already described in connection with FIG. 3, the instant when the servo piston 13' serving as the auxiliary pump piston begins to increase the amount of fuel enclosed within the assembly 72 or 81 may be precisely set by means of the corresponding arrangement of the control edge 75 on the servo piston 13'. In this way, the beginning of the elevation of closing pressure can be selected to be such that it first begins after the pump delivery is terminated and at the same time as, or shortly after, the the relief of the pressure line 48.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. In a hydraulically driven piston pump and nozzle assembly for a high pressure fuel injection system of an internal combustion engine, including: a pump piston; a servo piston having two end faces and a diameter larger than the diameter of the pump piston, said servo piston serving to drive the pump piston; a servo pressure chamber partly defined by one end face of the servo piston, said servo pressure chamber being placed under servo pressure in synchronization with the engine operation; an intermediate chamber partly defined by the other end face of the servo piston, said intermediate chamber pressure relieved during at least the greater portion of the pump piston stroke; a spring chamber; a closing spring disposed within the spring chamber; means defining a valve seat; a valve needle biased by the closing spring in the direction of fuel flow and against the valve seat; a closing pressure chamber disposed in the vicinity of the valve needle end remote from the valve seat; and an overflow channel connected to the closing pressure chamber through which fuel at elevated pressure is conducted to the closing chamber, the improvement comprising:

an auxiliary pump chamber; and an auxiliary pump piston axially movable within said auxiliary pump chamber, driven together with the pump piston and defining an effective work surface, wherein:

(i) the closing pressure chamber communicates through the overflow channel with the auxiliary pump chamber;

(ii) the auxiliary pump chamber is subjected to the effective work surface of the auxiliary pump piston; and (iii) the auxiliary pump chamber is placed under elevated fuel pressure, at the latest, shortly before the end of the pressure stroke of the pump piston.

2. In the hydraulically driven piston pump and nozzle assembly as defined in claim 1, wherein the improvement further comprises:

a refill valve which connects the auxiliary pump chamber to a source of lower pressure.

3. In the hydraulically driven piston pump and nozzle assembly as defined in claim 1, further wherein:

(iv) the auxiliary pump piston is located between the pump piston and the servo piston, is embodied with a diameter larger than the diameter of the pump piston, and defines an effective work surface at the cross-sectional surface of the pump piston.

4. In the hydraulically driven piston pump and nozzle assembly as defined in claim 1, further wherein:

(iv) the auxiliary pump piston is formed as an enlarged portion of the pump piston, with the exposed cross-sectional surface formed between the pump piston and its enlarged portion serving as an effective work surface.

5. In the hydraulically driven piston pump and nozzle assembly as defined in claim 1, further wherein:

(vi) the pressure in the closing pressure chamber is increased proportional to the pressure stroke of the pump piston and when the effective work surface of the auxiliary pump piston moves into the auxiliary pump chamber.

6. In the hydraulically driven piston pump and nozzle assembly as defined in claim 1, further including: a pressure line; a pump working chamber; a relief channel formed within the pump piston for connecting the pump working chamber and the pressure line at the termination of the fuel delivery stroke, further wherein:

(iv) the effective work surface is of such a dimension that the closing pressure generated in the auxiliary pump chamber undergoes a pressure increase causing an accelerated closing of the valve needle only after the pressure line has been relieved.

7. In the hydraulically driven piston pump and nozzle assembly as defined in claim 1, further including: a pressure line; a pump working chamber; a relief channel formed within the pump piston for connecting the pump working chamber and the pressure line at the termination of the fuel delivery stroke, the improvement further comprising:

a return flow channel serving to pressure relieve the intermediate chamber; further wherein:

(iv) the servo piston serves as the auxiliary pump piston;

(v) the auxiliary pump chamber is formed by a position of the intermediate chamber, said auxiliary pump chamber being placed under elevated pressure after the return flow channel is closed off; and (vi) the intermediate chamber is in constant communication with the closing pressure chamber by means of the overflow channel.

8. In the hydraulically driven piston pump and nozzle assembly as defined in claim 7, further wherein:

(vii) the return flow channel discharges into the cylinder wall of the intermediate chamber;

(viii) the discharge point of the return flow channel is controlled by a control edge of the servo piston defined by that surface of the servo piston facing the intermediate chamber;

(ix) the control edge defining surface is located at a distance from the bottom surface of the intermediate chamber such that the discharge point is closable, at least approximately, in the stroke position assumed by the servo piston at the beginning of the relief of the pressure line; and (x) the relief of the pressure line is controlled by means of the relief channel.

9. In the hydraulically driven piston pump and nozzle assembly as defined in claim 8, further wherein:

(xi) the closing off of the discharge point is controllable at substantially the same as the relief of the pressure line.

10. In the hydraulically driven piston pump and nozzle assembly as defined in claim 9, further wherein:

(xii) the pump piston includes a control edge which blocks the connection between the pump work chamber and the pressure line for the purpose of controlling termination of the fuel delivery; and (xiii) the connection between the pump work chamber and the pressure line is closable by means of the control edge on the pump piston at substantially the same time as the relief of the pressure line.

11. In the hydraulically driven piston pump and nozzle, assembly as defined in claim 1, further wherein:

(iv) the closing pressure chamber is formed by the spring chamber.

12. In the hydraulically driven piston pump and nozzle assembly as defined in claim 1, further including: a valve housing defining the valve seat; and an intermediate piston, further wherein:

(iv) the closing pressure chamber is separated from the spring chamber by the intermediate piston;

(v) the intermediate piston is sealingly guided within the valve housing, projects into the end of the spring chamber opposite the valve needle, and is displaced toward the valve needle by means of the elevated pressure in the closing pressure chamber.

13. In the hydraulically driven piston pump and nozzle assembly as defined in claim 1, the improvement further comprising:

a safety valve, further wherein:

(iv) the auxiliary pump chamber, the overflow channel and the closing pressure chamber comprise a control assembly serving to elevate the closing pressure against the valve needle; and (v) the elevated pressure developed in the control assembly is limited by means of the safety valve.

* * * * *